United States Patent [19]

Stickler et al.

[11] 4,278,445

[45] Jul. 14, 1981

[54] SUBSONIC-VELOCITY ENTRAINED-BED GASIFICATION OF COAL

[75] Inventors: David B. Stickler, Carlisle; Charles W. Von Rosenberg, Jr., Belmont; Richard E. Gannon, Andover, all of Mass.

[73] Assignee: Avco Everett Research Laboratory, Inc., Everett, Mass.

[21] Appl. No.: 44,020

[22] Filed: May 31, 1979

[51] Int. Cl.[3] ..... C10J 3/46

[52] U.S. Cl. ..... 48/197 R; 48/202; 48/206; 48/DIG. 4; 252/373

[58] Field of Search ..... 48/197 R, 202, 203, 48/206, 210, DIG. 4, 211, 213, 214 R; 252/373; 201/38; 208/48 Q, 129

[56] References Cited

U.S. PATENT DOCUMENTS

| | | | |
|---|---|---|---|
| 2,621,117 | 12/1952 | Garrison | 48/DIG. 4 |
| 2,767,233 | 10/1956 | Mullen et al. | 208/48 Q |
| 2,777,813 | 1/1957 | Totzek | 204/193 |
| 2,963,354 | 12/1960 | Atwell | 48/206 |
| 3,242,224 | 3/1961 | Howard . | |
| 3,746,522 | 7/1973 | Donath | 48/202 |
| 3,782,913 | 1/1974 | Donath | 48/210 |
| 3,840,354 | 10/1974 | Donath | 48/202 |
| 3,844,733 | 10/1974 | Donath | 48/202 |
| 3,988,123 | 10/1976 | Conte | 48/73 |
| 4,013,428 | 3/1977 | Babbitt | 48/202 |
| 4,136,015 | 1/1979 | Kamm et al. | 208/129 |

OTHER PUBLICATIONS

"Modelling of Entrained-Bed Pulverized Coal Gasifiers", Fuel, vol. 56, pp. 281-291, Jul. 1977, Ubhayakar et al.

"Coal Gasification in Steam at Very High Temperatures", Fuel, vol. 58, pp. 264-268, Apr. 1979, Northam et al.

Rapid Devolatilization of Pulverized Coal in Hot Combustion Gases, Ubhayakar et al., 16th Symposium MIT, Aug. 1976.

Coal Gasification, Massey (Editor), ACS Series 131, 1974, pp. 1, 3, 92, 93, 106, 107, 126-129.

"An Evaluation of the BCR Bi-Gas SNG Process", Hegarty et al., Chem. Eng. Prog., vol. 69, No. 3, Mar. 1973.

"Gas Generator Research and Development Survey and Evaluation", Office of Coal Research, 1965.

"Pulverized-Coal Gasification, Ruhrgas Processes", Traencknes, Trans. A.S.M.E., Aug. 1953, pp. 1095-1101.

"Shock Waves in a Dusty Gas", G. F. Carrier, Journ. of Fluid Mechanics, vol. 4, Part 4, Aug. 1958, pp. 376-382.

*Primary Examiner*—Peter F. Kratz

*Attorney, Agent, or Firm*—M. E. Frederick

[57] ABSTRACT

A process and apparatus for gasification of carbonaceous matter, preferably coal, is disclosed. In one embodiment, a stream of previously produced char, preferably produced from coal or other fuel, together with an oxidizer and steam is introduced into a combustion stage. The combustion gas produced by the combustion passes into a mixing zone and thence with high turbulence into a gasification zone or stage at subsonic velocity. Pulverized carbonaceous matter, preferably coal, is introduced and dispersed in the combustion gas in the mixing zone. The temperature, velocity and velocity changes principally of the gas in the gasification zone or stage are controlled to provide a heating rate for the particles of pulverized carbonaceous matter of at least about $10^5$ degrees Kelvin per second, and to effect rapid removal of volatile components from the immediate vicinity of the particles. Upon substantial gasification of the particles in the gasification stage, the resultant product stream may be quenched, the char removed, and preferably at least a portion thereof introduced into the combustion stage.

12 Claims, 4 Drawing Figures

SUBSONIC-VELOCITY ENTRAINED-BED GASIFICATION OF COAL

REFERENCE TO RELATED APPLICATION

This application is related to applicants' co-pending application entitled "Very-High-Velocity Entrained-Bed Gasification of Coal", Ser. No. 044,354 filed simultaneously with this application on May 31, 1979 and assigned to the same Assignee as this application.

BACKGROUND OF THE INVENTION

Field of the Invention

This invention relates to gasification of carbonaceous material, and more particularly to a two stage entrained-bed gasification process and apparatus therefor for gasifying coal.

Treatment of carbonaceous material such as, for example, coal with heat and pressure in order to drive off the volatile components and provide solid, liquid and gaseous products for fuels and chemicals has been carried out by several processes for over a century.

This technology was used as early as 1807 when town gas produced from coal lit a public street in London. By the turn of the century, German chemists were making a number of products from coal. A large part of the WW II German war machine was fueled by gasoline made from coal. Low Btu gas from coal was also widely used in the United States before the advent of cheap natural gas and oil. Cheap gas and oil pushed coal gasification technology aside, and it did not undergo any major technological advancements until it reemerged recently because of, among other things, substantial increases in the cost of natural gas.

The gasifier or reactor is the heart of a coal gasification process and there are four main types of gasifiers, all of which rely upon external sources of heat or the burning of part of the coal to provide the heat needed to effect gasification.

One well-known type of gasifier, of which the Lurgi device is typical, is the fixed-bed gasifier. In this type of gasifier, sized coal is supplied to the top of the gasifier and the gasifying medium such as oxygen and steam is injected at the bottom. Such gasifiers utilize the lowest operating temperatures and require long residence times of up to 1 hour. Due to the low temperatures used, large amounts of heavy liquids are produced. Ash is removed from the bottom of the gasifier as dry ash or slag depending on the operating temperature. For slagging operation, the gasifier is run at comparatively higher temperatures thus requiring more oxygen and less steam, but providing a faster reaction rate than for the non-slagging mode of operation.

Inherent advantages of a fixed-bed process are high thermal efficiency and carbon conversion and low contamination of gas with solids. Among the disadvantages are that caking coals cannot be used without pretreatment. The coal must have uniform size and good mechanical strength. Production of heavy hydrocarbons is undesirable if the gas produced is to be used as synthesis gas or to produce high Btu gas.

A second type of gasifier is the fluidized-bed gasifier which operates with crushed or fine coal. The fluidized-bed gasifier as compared to the fixed-bed gasifier allows improved gas-solid mixing, uniform temperature distribution and improved gas-solid contact. Fluidized-bed gasifiers can tolerate variations in coal feed during operation, have high gasification rates per unit cross-sectional area and can operate over a large range of output without significant loss in efficiency. Fluidized-bed gasifiers in general require pretreatment of caking coals and longer residence times when compared with entrained-bed gasifiers discussed below. Temperatures are lower than entrained-bed gasifiers, but higher than fixed-beds. Exit gases generally have high dust loading and the range of operating conditions is limited because of fluidization characteristics of particles and danger of entrainment.

A third type of gasifier is the molten bath (salt or iron) gasifier wherein coal is fed with oxygen and steam into a molten bath. Ash and other impurities float to the top as slag and are removed.

The fourth type of gasifier is the entrained-bed which may be divided into single stage and two stage types.

The single stage type is sometimes referred to as the partial oxidation gasifier. In this type, pulverized coal and the gasifying medium, typically oxygen and steam, are fed cocurrently and the coal is gasified in more or less suspension. The exit gas has little or no tars or methane because at the high temperatures used, the homogeneous gas-phase reactions proceed to thermodynamic equilibrium. To run the gasifier at high temperatures, larger amounts of oxygen may be required compared to fluidized or fixed-bed types. The exit gases have high temperatures and high loading of ash particles. Overall fuel-gas production rates per unit volume of gasifier space are higher than in fluidized or fixed-bed types because of both high reaction temperatures and large particle surface area.

The two stage entrained-bed gasifier, developed at Bituminous Coal Research, Inc., Pittsburgh, PA in the 1960's has perhaps the greatest potential for development of known gasification processes. The present invention is an improvement of the two stage entrained-bed gasifier.

In the two stage type, pulverized coal is introduced into a second or gasifier stage to produce a process gas and a process char. This process char is separated from the process gas and recycled and reacted with oxygen and steam in a first or cumbustion stage to produce hot combustion gas. As used herein "combustion gas" includes carbon dioxide and water vapor, together with hydrogen and carbon monoxide. The hot combustion gas from the combustion stage is introduced into the aforementioned second stage and contacts the pulverized coal introduced into the second stage. Here the coal is heated and reacted in contact with the combustion gas and steam to produce synthesis gas, some methane, and process char. This gasification reaction is carried out typically at low gas flow velocities of the order of 2–12 feet per second, pressures of about 60 atmospheres and temperatures of about 1200° K.

The pressure and temperature of the combustion gas produced in the first stage are such that in the second or gasifier stage, the classic carbon/steam and carbon/carbon dioxide reactions take place to produce CO and $H_2$.

Upon issuing from the second stage the exiting gases and entrained char are passed into a quenching zone to cool the gas and char to below the reaction temperature. Thereafter, the quenched process stream is separated into its gaseous and char components.

This process and apparatus have the ability to produce a tar-free, low-sulfur content char product in addition to a gaseous product. For a more complete discussion of the two stage entrained-bed gasifier, reference is made to Department of Interior, Office of Coal Research publication, dated 1965 and entitled "Gas Generator-Research and Development Survey and Evaluation" prepared by Bituminous Coal Research, Inc.; "An Evaluation of the BCR Bi-Gas SNG Process", W. P. Hegarty et al, Chemical Engineering Progress, Vol. 69, No. 3, March 1973; U.S. Pat. No. 3,746,522, issued July 17, 1973; U.S. Pat. Nos. 3,782,913 issued Jan. 1, 1974; U.S. Pat. No. 3,840,354 issued Oct. 8, 1974; and U.S. Pat. No. 3,844,733 issued Oct. 29, 1974; all of which are incorporated herein as if set out at length.

It has become known in recent years, from the data of experiments performed by ourselves and others, that if coal particles are subjected to very high heating rates, of the order of $10^{5°}$ K./sec and higher, a much larger fraction of the coal mass may be devolatilized than the so-called "volatile matter" content of the coal as defined by ASTM Proximate Analysis. In view of the rapidly-changing and somewhat inhomogeneous conditions in such experiments, it is customary to express properties such as velocity, temperature and heating rates in terms of suitable spatial or temporal averages. The cited very high heating rate of $10^{5°}$ K./sec or higher is such an average over the brief period of devolatization.

The value of heating rates on the order of $10^{5°}$ K./sec and higher has been documented in reports of laboratory experiments, viz:

(1) Kimber, G. M. and Gray, M.D., "Combustion and Flame", 11, 360, (1967).

(2) Ubhayakar, S. K., Stickler, D. B., von Rosenberg, C.W., Jr., and Gannon, R.E., "Rapid Devolatilization of Pulverized Coal in Hot Combustion Gases", 16th Symposium (International) on Combustion, 427, (1976).

When done under well-mixed conditions with high temperatures ($T \geqq 1400°$ K.), such large heating rates were shown to lead to larger yields of volatiles than conditions with slower heating rates. However, a potential benefit resulting from such heating rates, recognized by us and enjoyed by our invention is a reduction, or even elimination, of the requirement for prior art heterogeneous gasification reactions, which are slow and inefficient. Consequently, use of high heating rates can lead to smaller amounts of oxygen consumption for the total process.

It must be pointed out that the above-noted data were obtained under laboratory conditions, using means or methods not practical for commercial gasification. Existing two-stage gasifiers have residence times which are at least two orders of magnitude longer than those required for operating with the higher degree of devolatilization. We perceive that the reason for this is as follows: a coal particle must be very small if it is to be heated rapidly, even in a very high temperature gas. But heretofore such small particles were permitted to mix slowly with respect to the entrained hot gas, so that heat is brought to them relatively slowly. Such heating is "mixing limited". Heating under "mixing limited" conditions occurs when the characteristic mixing time is greater than the characteristic time for diffusive heat flow to the coal particles and for thermal diffusion within the particles. Similarly, any volatiles arising from such a particle were also permitted to tend to remain near the particle, and to degrade to soot rather than reacting with the surrounding gas to form stable hydrocarbons. Such stabilization is also mixing limited. And the final attainment of equilibrium of the heterogeneous reaction between coal and soot particles and the surrounding gas is also mixing limited. As a result, the present state of the art in two stage entrained-bed gasifiers is such that the heating rate of the carbonaceous matter particles and the residence times for reactants in the gasification stage are mixing limited. For one example, the gasifier described in the aforementioned Donath U.S. Pat. No. 3,782,913 depends on high pressure, residence times of 5 to 15 seconds and equilibrium chemistry to yield product gas containing essentially the equilibrium amount of methane.

In one set of our experiments, for example, coal was subjected to steam at 1370° K. and 10 atm pressure for reactions times of 50 milliseconds and generated methane in excess of that expected based on equilibrium calculations. Further data obtained by us have shown that under conditions of rapid heating to temperatures of 1370° K. and higher, of finely pulverized coal well-dispersed in a background of steam, followed by rapid cooling, one can obtain methane concentration in the product gas which is substantially larger than would be predicted by equilibrium considerations for the experimental reactor conditions. The detailed reaction chain leading to this is not known, but it is well-known that to attain an equilibrium composition in any chemical reactor requires adequate time. The experimental conditions provided initial temperatures and reaction times which were sufficient for pyrolyzing large amounts of mass from the coal, but at later stages the temperature-time history was inadequate for attaining equilibrium among the gas phase constituents.

We believe that particle reaction in the reducing gasifier environment in accordance with out invention attains enhanced volatilization through a non-equilibrium rapid direct pyrolysis pathway, rather than through the usual prior art equilibrium heterogeneous reaction process. Our invention is thought to give hydrocarbon radicals which react homogeneously with background gas to yield a non-equilibrium product distribution which can be retained by sufficiently prompt cooling. Whateever the reason may be, it is clear that extremely rapid heating of coal particles yields copious amounts of volatiles. This is preferably done in the presence of gases which react with and stabilize the volatiles to prevent formation of soot, and with sufficiently prompt cooling to prevent shift of the composition to equilibrium values.

SUMMARY OF THE INVENTION

It is therefore the general object of this invention to provide a process and apparatus for practical gasification of carbonaceous matter, utilizing a very high heating rate of that matter to achieve a greater yield of gas. It is a particular object of this invention to provide a process and apparatus which are not mixing limited in heating rate of the carbonaceous matter or in stabilization of volatiles arising from such matter.

According to this invention, these objects are achieved by fluid-dynamic provisions which preferably strongly move small particles of the carbonaceous matter in the gasification stage with respect to their surrounding gas, thus obtaining high physical transport interaction between the particles and the gas. In general, this transport interaction is achieved by forcing a velocity differential between the gas and the particles, using the inertia of the particles and one or more strong accelerations and decelerations of the gas. In particular, in this invention, such accelerations and decelerations are provided by introducing and dispersing the particles of carbonaceous matter into a subsonic flow of hot combustion gas from one or more combustion stages introduced into a mixing zone, passing the resultant mixed flow through a gasification duct, and generating and augmenting accelerations and decelerations of the mixed flow by at least one of the following provisions: induction of highly turbulent flow in the mixing zone through high velocity introduction of combustion gas, bulk gas accelerations by changes of duct form, and induction of turbulent flow in the gasification duct by protuberances therein.

It is to be understood that the present invention may be used with first-stage combustion fuels other than char produced from the gasification of coal, as well as with carbonaceous matter other than coal in the second or gasification stage. For one example, the present invention may be employed to gasify any solid carbonaceous material which can be comminuted, such as sawdust, wood wastes, peat or agricultural waste. For another example, the present invention can be employed to gasify liquid carbonaceous material which can be atomized, such as petroleum products in crude, refined or residual form, crude molasses or spent solvents. For still another example, the present invention when employed to gasify liquid carbonaceous material, may produce a tarry or solid residual material which may serve as a char fuel for the first stage. For purposes of convenience, the present invention will be described in connection with the use of coal char and coal. It is to be further understood that part of the first stage heat may be obtained through preheat of the fuel, steam or oxidizer.

This invention provides an improved two stage gasification process and apparatus wherein a char and a product gas including methane comprise the principal products. In the first or cumbustion stage, a combustion fuel such as char is reacted with oxygen and steam at high temperature and elevated pressure to produce products of combustion including combustion gas comprising principally water vapor and carbon dioxide with a lesser amount of hydrogen and carbon monoxide. The combustion gas is introduced into the second or gasification stage where it is passed into a mixing zone and thence through a gasification duct. In this gasification stage, strong accelerations and decelerations of gas flow are generated by provisions such as induction of highly turbulent flow and changes of form of the gasification duct.

The carbonaceous material to be gasified, such as, for example, pulverized coal, together with carrier gas as necessary, is introduced and dispersed in the mixing zone of the second stage where its interaction with the accelerated, high temperature, flow conditions, and with the immediately subsequent strong changes of gas velocity in the gasification duct, provide rapid mixing of the coal particles with the combustion gas, rapid movement of the coal particles with respect to the gas, and high heating rates with consequent maximum coal conversion to volatile components through rapid pyrolysis. The rapid mixing and movement also promote stabilizing reactions between the volatile components and combustion gas, thus minimizing soot formation. Further, the rapid flow has, as a consequence, very high throughput.

Similarly, a liquid carbonaceous material or char therefrom may be burned in the first stage, and a further supply of liquid carbonaceous material introduced into the second stage. There its interaction with the velocity fluctuations result in rapid mixing of vaporized hydrocarbons with reactive combustion gas for stabilization. In the case of liquids containing substantial amounts of residual low vapor pressure material which may serve as a kind of char fuel, separation and recycle of such char to the first stage combustor may be preferred.

The resulting product stream may be quenched and any entrained char separated and supplied to the first stage. The gaseous product from the second stage may be used as a basis for gas to be used in various chemical processes, as a fuel gas or as pipe line gas. For the purpose of producing fuel gas, the gaseous product may be passed through a water gas shift reaction stage, cooled and any undesirable remaining constituents such as, for example, sulfur compounds removed.

This invention therefore provides an improved two stage entrained-bed gasification process and apparatus therefor.

The invention further provides an improved two stage entrained process and apparatus therefor having a higher than heretofore achieved throughput of carbonaceous matter processed under conditions leading to higher yields of volatile matter from the carbonaceous matter than heretofore attainable.

The invention is not mixing limited to the extent of the prior art and as a result, permits up to two orders of magnitude or more increase in heating rate. This, in turn, leads to substantial improvement in utilization of the devolatization reaction and concomitant reduction in the demands on the slower, less efficient char/steam and char/$CO_2$ heterogeneous reactions. This, in turn, leads to a larger yield of product gas for a given amount of oxygen consumption than heretofore. This invention also permits up to about two orders of magnitude decrease in reaction residence time with concomitant very high throughput.

In addition, the invention allows for the production of larger than equilibrium amounts of methane. This is possible by virtue of the predominant chemical route being pyrolysis of the carbonaceous matter in the gasification stage followed by homogeneous gas phase stabilization reactions, under conditions of rapid heating followed by sufficiently prompt cooling.

Thus, the present invention utilizes the chemical composition of the pyrolysis products to yield greater than equilibrium amounts of methane, directly and as a result of the reaction of those pyrolysis products with the surrounding gas.

The invention provides further improved performance since it produces higher interaction of nascent volatile matter with the background combustion gas which leads to increased amounts of homogeneous gas phase reactions which, in turn, leads to stable synthesis gas and product gas rather than soot.

This invention, by use of subsonic, highly accelerated flow at high temperature achieves previously unattained and unappreciated rates of heating and mixing. By passing the flow through a duct in which flow accelerations and decelerations may be generated or augmented, the invention achieves improved very high rates of heating and mixing.

BRIEF DESCRIPTION OF THE DRAWINGS

FIG. 2 is a diagrammatic representation in cross section of apparatus in accordance with the invention;

DESCRIPTION OF THE PREFERRED EMBODIMENT

Figure 1:
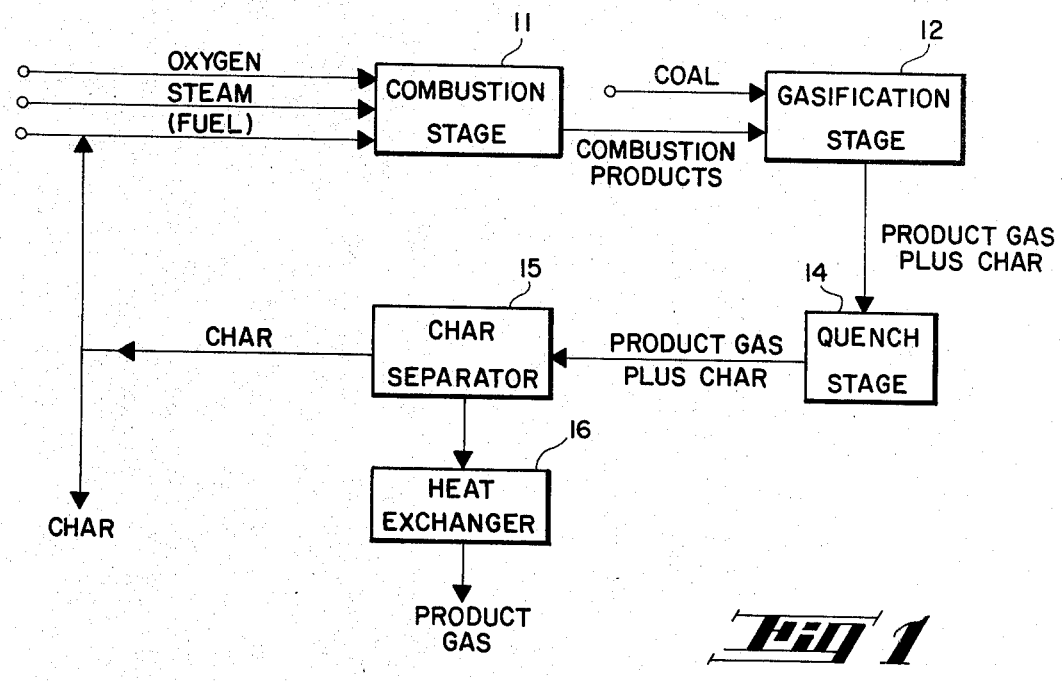
FIG. 1 is a block diagram of apparatus for carrying out a process according to the invention.

Referring now to FIG. 1 which illustrates the process of the present invention, pulverized fuel, oxidizer and steam are introduced as shown to the combustion stage 11. The fuel may include coal or the like, but preferably is char separated from the product stream, the oxidizer is preferably oxygen and the steam is preferably superheated steam.

The combustion stage 11 for operation at high or relatively high temperatures is coupled to the gasification stage 12 more fully described in connection with FIGS. 2, 3 and 4. The fuel and the oxidizer are combusted in the combustion stage 11 to produce products of combustion including combustion gas and to superheat the steam mixed therein to the high exit temperature of the gases of the combustion stage. In the combustion stage, the reaction of char, oxygen and steam is exothermic and in accordance with the invention, provides a temperature of about 1900° K to 2800° K, depending on the type and quantity of fuel and oxidizer used and the temperature and volume of steam. The char is substantially completely gasified and the combustion gas issuing from the combustion stage comprises water vapor and carbon dioxide together with hydrogen and carbon monoxide. The combustion stage may also be provided with slag removal means to remove excess slag. For gasification applications where lower heating value gas suffices, all or part of the oxygen may be replaced by air, with suitable reduction of steam input to achieve the requisite high temperature of combustion gas.

The combustion gas including the steam plus any residual char or mineral matter is passed into a mixing zone 22 (see FIG. 2) in the gasification stage 12 into which pulverized coal is simultaneously introduced and dispersed. In the gasification stage 12, a reaction takes place to produce a product gas comprising CO and $H_2$ and $CH_4$, with a minimal amount of $CO_2$ regardless of the fuel and oxidizer used.

Upon completion of the reaction in the gasification stage 12, if cooling of the gas is required, the product gas may be introduced into the quench stage 14. The quench stage may include a zone of injection of cold fluid such as water or may comprise a heat exchanger. The cooled product stream including char is then introduced into the char separator 15 such as, for example, a conventional cyclone separator. If desired, the quench stage may be included in the char separator. In the cyclone separator, product gas is continuously withdrawn in a conventional manner and supplied to, for example, a heat exchanger 16 for extracting useful heat and for cooling the product gas, and to shift conversion means (not shown) for further processing. The separated char is separately withdrawn in conventional manner and at least a portion supplied to the combustion stage 11 as fuel. Where there is excess char, the balance may be withdrawn and used for power plant fuel or the like.

Upon separation, the char may, if desired, be collected in char hoppers (see FIG. 2) operating as lock hoppers in a switching cycle to transfer char from the cyclone separator to the char hoppers which operate at high presssures. From the char hoppers, the char may be metered into the combustion stage in a suitable carrier gas such as product gas.

The char may be metered by means such as starwheel feeders (not shown) and entrained into the combustion stage.

Finely pulverized coal may be metered from piston feeders or coal feed hoppers by a starwheel feeder (not shown) into a pressurized carrier fluid such as, for example, product gas and carried to the gasification stage 12 as a pressurized dense fluidized phase.

In the combustion stage 11, if loss of steam feed occurs, temperatures could approach unsafe values unless the process is immediately shut down. Accordingly, careful installation and start-up and shut-down procedures suitable to provide the desired level of protection are recommended.

In the combustion stage, the reaction of char, oxygen and steam is exothermic and in accordance with the invention, provides a temperature of about 1900° to 2800° K. The char is substantially completely gasified and the products of combustion issuing from the combustion stage comprise water vapor (the steam) and carbon dioxide, together with hydrogen and carbon monoxide. The combustion stage may also be provided with slag removal means (see FIG. 2) to remove excess slag from the combustion stage. Upon introduction into the gasification stage and contacting the pulverized coal in the manner more fully described hereinbelow, the coal is rapidly heated and reacts with the combustion gas and steam to produce synthesis gas, methane and char.

Directing attention now to FIG. 2, there is shown, in diagrammatic form, a combustion stage and a gasification stage combined in accordance with the present invention, together with the principal associated and auxiliary components required for a gasification apparatus.

Combustion stage 11 comprises a combustion vessel 31 into which char, superheated steam and oxygen are introduced and react to provide products of combustion including combustion gas at a pressure of about 1–100 atmospheres, with a preferred range of about 2–10 atmospheres, and a temperature of about 1900° to 2800° K. The combustion gas comprises principally $CO_2$ and $H_2O$ with a lesser amount of CO and $H_2$. The walls of combustion vessel 31 are preferably water-cooled and become coated with a layer of solidified slag, over the surface of which molten slag, derived from the mineral content of the char, flows downward to frustro-conical vessel bottom 32. Thence, the slag may flow through slag taphole 33, whence it may fall into quench water in slag receiver 34 and be solidified as broken particles of slag. In order to prevent freeze-up of slag in taphole 33, a very small flow of hot combustion gas may be passed downward through the taphole and into receiver 34, and thence through cooler 35 and throttle valve 36. The heat extracted in cooler 35 may be utilized to heat feed water, and the combustion gas throttled through valve 36 may be discarded or employed elsewhere in the process. Solidified slag particles may be removed from receiver 34 through slag lock 37. During start-up of the combustion stage, gas fuel may be introduced therein in lieu of char, and steam flow may be adjusted for temperature control.

Combustion stage 11 provides a flow of hot combustion gas to gasification stage 12 which comprises successively at least one entrance duct 21 leading to a mixing zone 22 in which the incoming high-temperature flow from the combustion stage 11 is forced to mix rapidly with the coal feed, for example, by using very turbulent flow in the manner characteristic of the so-called jet stirred reactor. The turbulent flow then passes at high subsonic velocity through gasification duct 23 in which flow turbulence may persist and in which fluid accelerations and decelerations may be forced by one or more repetitive changes of duct form. As illustrated by way of example in FIGS. 3 and 4, these changes may take different forms. Pulverized coal, together with carrier gas, mixed and pressurized in injector means 16 or 26 is introduced, dispersed and mixed in the flow of hot products of combustion in mixing zone 22. The details of such introduction, dispersion and mixing, and the process advantages resulting from passing the mixture of coal and gases through augmented accelerations and decelerations in gasification duct 23, will be set forth hereinafter with reference to FIGS. 3 and 4.

The output stream from gasification duct 23, now mainly synthesis gas and methane carrying char particles may, if desired, be quenched by addition of water or steam in duct 14 which, therefore, constitutes a quench stage. Such quenching should be to a temperature which is low enough to suppress further chemical reactions in the product stream and to be withstood by the following char separator 15, but still high enough for raising steam in the following heat exchanger 16. Such quenching will not usually be necessary due to the overall endothermic nature of the pyrolysis and gasification reactions taking place in turbulent mixing zone 22 and gasification duct 23. However, as a safety measure, provision should be made for introducing a flow of water into those regions in the event of a stoppage of coal flow and in the course of system start-up, since then the endothermic reactions would not take place, and the gas stream temperature might reach levels which could damage downstream components.

Char particles are removed from the output stream in char separator 15, yielding a clean hot product gas which is cooled in heat exchanger 16 and hot char which is collected in one or more char bins **17*a* and 17*b*. At least a portion of the collected char is withdrawn through a char lock 18*a* and is passed through char injector 19 for introduction into combustion vessel 31. The carrier gas for such injection may advantageously be product gas from the output of heat exchanger 16, pressurized by compressor 20. When there is excess collected char, the balance may be withdrawn through another char lock 18*b***, and used for plant fuel or the like. Steam may also be employed as a carrier gas for the injection of char.

Figure 3:
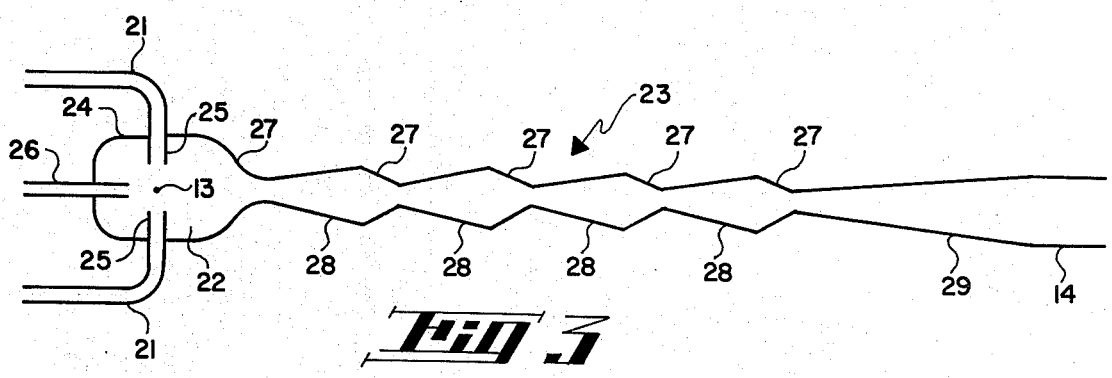
FIG. 3 is an enlarged diagrammatic representation of a portion of the gasification stage of the apparatus in accordance with the invention.

Directing attention now to FIG. 3, there is shown in enlarged diagrammatic form for one embodiment of this invention, that portion of gasification stage 12 comprising contiguous portions of entrance ducts 21 leading to turbulent mixing zone 22, gasification duct 23 and the contiguous portion of quench duct 14. As shown in FIG. 3, entrance ducts 21 are sealably introduced into reaction vessel 24 in which a highly turbulent mixing zone 22 is to be produced. To that end, entrance ducts 21 are provided with constricted nozzle ends 25 directed toward a common convergence point 13 within the reaction vessel 24. Conversion into turbulence, of the kinetic energy of the flows through nozzle ends 25, produces a strongly turbulent mixing zone 22, particularly in the vicinity of convergence point 13 and generally throughout the interior of reaction vessel 24. Into that mixing zone, finely divided coal or other carbonaceous material in a carrier gas is introduced through coal pipe 26, and is thereupon rapidly dispersed in the highly turbulent flow of hot combustion gas. Because of the high and frequent accelerations and decelerations of the gas in this highly turbulent flow, and the inertia of the coal particles, strong velocity differentials between particles and gas are forced, thus causing high physical transport interaction therebetween. In consequence, the particles are subjected to very rapid heating by the hot combustion gas, and the resulting volatiles are promptly swept away from the particles and are stabilized by reaction with the combustion gas.

There is a tendency for flow turbulence to decay slowly in a flow system. Therefore, under the high temperature, high heating rate conditions existing in a gasifier according to this invention, and with a sufficiently high level of initial turbulence in mixing zone 22, the mixed flow may be led through a plain gasification duct 23 long enough for the gasification process to complete itself, depending upon the accelerations due to the slowly decreasing turbulence and the decreasing bulk fluid velocity to provide the desired high physical transport interaction. However, these accelerations and decelerations of the turbulent flow may not only be maintained, but also augmented by additional accelerations and decelerations imposed by fluid dynamic means. In the embodiment of the invention shown diagrammatically by way of example in FIG. 3, the fluid dynamic means is a repetitive sequence of decreases 27 and increases 28 of duct area which forces a corresponding sequence of increases and decreases of gas velocity. As shown in FIG. 3, the increases in duct area are preferably less abrupt than the decreases, because of the necessity for avoiding flow separation and consequent loss of deceleration. A wall divergence angle of the order of one-tenth radian may be tolerated.

The gasification duct 23 of the embodiment shown in FIG. 3 therefore comprises a sequence of subsonic convergent nozzles 27 and subsonic diffusers 28. The sequence is completed with a further subsonic diffuser 29 which slows the flow for introduction into quench duct 14.

Figure 4:
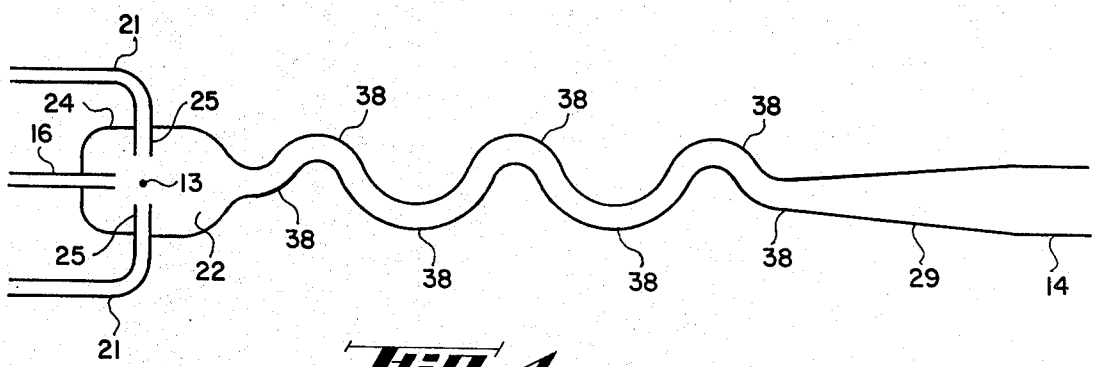
FIG. 4 is a further enlarged diagrammatic representation of a similar portion of the gasification stage of another embodiment of the invention.
Figure 1:
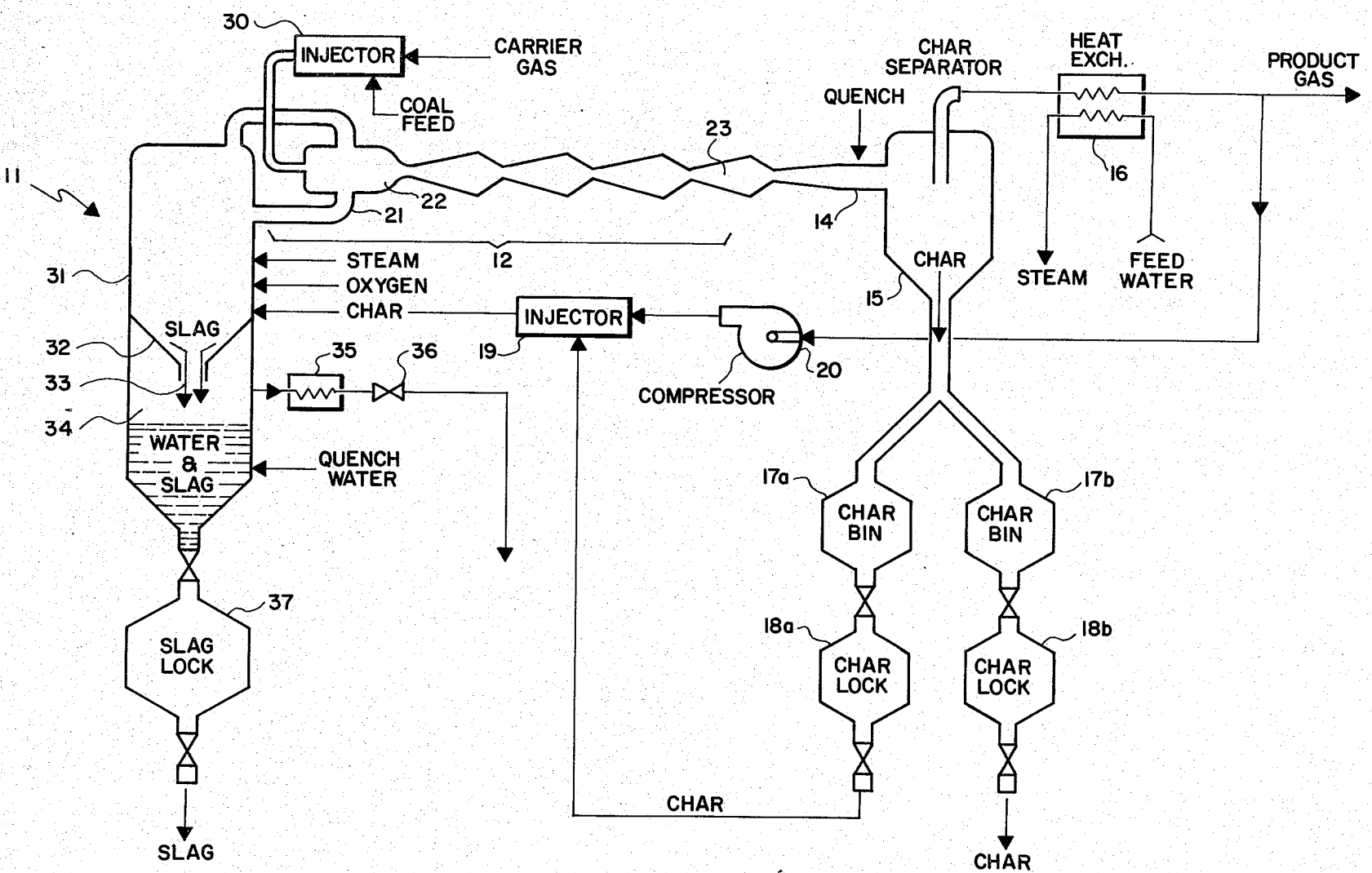

Directing attention now to FIG. 4, there is shown in enlarged diagrammatic form that same portion of gasification stage 12 shown in FIG. 3, but illustrating an alternative embodiment of this invention. As shown in FIG. 4, the fluid dynamic means used to augment the accelerations and decelerations of the turbulent flow is a repetitive sequence of bent duct segments 38 in gasification duct 23. While the gas flow follows the bends, the particles, due to their inertia, tend to follow a straighter course. Consequently, the gas not only flows in a laterally oscillatory manner with respect to the entrained particles, but actually follows a longer course than that followed by a typical particle. These differences of path result in strong velocity differentials between particles and gas and consequently high physical transport interaction.

The gasification duct 23 of the embodiment shown in FIG. 4 therefore comprises a sequence of bent duct segments 38. Again, the sequence is completed with a subsonic diffuser 29. Further, it will be appreciated by those skilled in the art that the concepts illustrated by FIGS. 3 and 4 may be combined.

A further form of gasification duct 23 may have one or more flow blockage locations defined by protuberances, such as downstream facing wall steps or supported bluff bodies, of form and placement chosen to convert a portion of the fluid total pressure to strong turbulent velocity fluctuations.

In another alternative embodiment of this invention, the finely divided carbonaceous material may be introduced and dispersed in a weakly turbulent flow in mixing zone 22, and the resulting mixed flow promptly introduced into gasification duct 23 wherein changes of duct form generate strong accelerations of gas flow and consequent strong velocity differentials between particles of carbonaceous material and the surrounding hot combustion gas. In all the mentioned embodiments, dispersed particles of carbonaceous material are promptly exposed to strongly accelerated flow of the surrounding hot combustion gas, whereby heating of the particles, sweeping away of their volatiles, and stabilization of volatiles by reaction with the combustion gas, are not mixing limited.

In proportioning a gasifier according to this invention, the following considerations are of importance: in order to achieve the requisite particle movements with respect to the surrounding hot gas, it is calculable, using methods described hereinbelow, that mean gas flow velocities should be of the order of 10 meters per second to 500 meters per second, with a preferred range of 20 to 100 meters per second. Since particle-gas interaction times of the order of 100 milliseconds may suffice to accomplish thorough volatilization of the coal particles and stabilization of the volatiles by the surrounding hot gas, it can be seen that the previously recited preferred mean gas velocities require gasifier flow path lengths of only 2 to 10 meters, a convenient range of sizes.

Using the same methods described hereinbelow, it is calculable that, for apparatus according to this invention, gasifier stage dimensions scale almost proportionally with the mean gas flow velocity, for constant particle-gas interaction, and that mass flow scales roughly as the five-halves power of that velocity. Because of this fairly steep dependence, mean gas flow velocities below the lower end of the preferred range tend to yield throughput which is smaller than that required by most prior art installations. Conversely, for gas velocities above the upper end of the preferred range, throughput tends to be large compared to the requirements of most prior art installations.

As may now be seen from the above, gasifiers in accordance with the present invention permit the fabrication of gasifiers in the range of very small ones to very large ones without any substantial loss of efficiency and with inherent advantages over prior art devices.

It is a further unexpected but fortunate property of a gasifier in accordance with this invention that the operation of the device is relatively insensitive to the exact fineness or fineness distribution of the pulverized coal or other carbonaceous matter. That this is so may be understood from consideration of the following fluid-dynamic facts: Under the strongly accelerated flow conditions existing in a gasifier in accordance with the present invention, and for typical particle sizes of finely pulverized coal, the Reynolds number of the gas flow around a particle is in the general range of 1 to 1000. In this range of Reynolds numbers, the coefficient of fluid-dynamic drag of a particle varies approximately inversely as the square root of the Reynolds number. Using this fact in an analysis of the motion of a typical particle in such an accelerated gas flow, one arrives at a surprising but interesting result—that the velocity of such a particle, with respect to the surrounding gas, is essentially proportional to the particle diameter, and that therefore, particles of differing sizes, in equally accelerated flows, will move equal multiples of their own diameters in a given time. In brief, the velocities of particles with respect to accelerated gas flow are nearly proportional to the first power of particle size.

For the same fluid-dynamic flow regime noted above, one can calculate a characteristic motion damping time, for a particle to lose a considerable fraction of an initial velocity with respect to surrounding gas. By such an analysis, one finds that this damping time is a very weak function of such operating parameters as temperature and pressure, that it varies inversely as the one-half power of the initial velocity, and directly as the three-halves power of the particle diameter. This damping time, together with the particle velocity in an accelerated flow, defines a characteristic particle motion distance which can be seen to be proportional to the five-halves power of particle diameter. This distance, in the context of a film of reactive hot gas which has a thickness which may be a weak function of particle diameter, leads to the surprising but fortunate discovery that the mass of hot gas with which a particle may react, is roughly proportional to the third power of particle diameter, that is to the mass of the particle. It is therefore clear that, under the flow conditions existing in a gasifier according to this invention, particles of differing diameter may encounter roughly equivalent degrees of total physical transport interaction with the surrounding hot gas, and that operation of the device may be relatively insensitive to the exact fineness or fineness distribution of the pulverized coal.

Examination of the aforementioned analyses, for the dependence of particle motion distance upon such parameters as pressure and mean flow velocity, reveals a useful relationship: varying mean gas flow velocity approximately as the one-third to one-fourth power of the operating pressure yields a substantially unaltered level of particle-gas physical transport interaction, in terms of the mass of the particle compared to the mass of surrounding hot gas which it encounters in a typical particle gas motion. Consequently, a gasifier according to this invention, utilizing strongly accelerated flow in this Reynolds number regime, may provide a substantial range of throughput turndown capability by suitably varying operating pressure and mean flow velocity in the same sense. Since prior art entrained flow devices operate in a different flow regime, they can scarcely attain a 2:1 turndown capability. Accordingly, the greater potential turndown capability of a device according to this invention is most attractive.

With the preceding discussion, those skilled in the art may readily conceive other configurations and arrangements that will provide comparable accelerations and decelerations in a subsonic flow in the gasification stage as and for the same purposes described herein. For example, a differing number of entrance ducts 21 may be provided, or a plurality of convergence points 13 in order to achieve particular patterns of strongly turbulent flow and mixing. For another example, the entrance ducts may be directed to cause impingement of the jets upon a suitably shaped portion of the wall of reaction vessel 24.

The various features and advantages of the invention are thought to be clear from the foregoing description. Various other features and advantages not specifically enumerated will undoubtedly occur to those versed in the art, as likewise will many variations and modifications of the preferred embodiment illustrated, all of which may be achieved without departing from the spirit and scope of the invention as defined by the following claims:

We claim:

1. A process for the gasification of solid carbonaceous fuel comprising:

(a) combusting carbonaceous matter and an oxidizer in a combustion stage whereby said carbonaceous matter and oxidizer are reacted and hot products of combustion including hot combustion gas are formed;

(b) introducing steam into said combustion stage to provide an ingredient of said combustion gas;

(c) introducing said combustion gas into a mixing stage through which said combustion gas flows at subsonic velocity and at a predetermined level of turbulence;

(d) introducing and dispersing finely divided solid carbonaceous fuel in said combustion gas in said mixing stage to form a mixed flow of particles of dispersed solid carbonaceous fuel entrained in surrounding hot combustion gas;

(e) introducing said mixed flow into a gasification stage having a duct and through which said mixed flow flows at subsonic velocity with a mean gas flow rate of 10–500 m/sec.;

(f) providing one or a plurality of fluid-dynamic bulk gas accelerations and decelerations to said mixed flow whereby said particles are strongly moved with respect to said surrounding hot gas by forcing a velocity differential between said particles and said gas using the inertia of said particles and accelerations of said gas, said mixed flow having accelerations and decelerations and said hot gas having an initial temperature sufficient that said particles are subjected to an average heating rate of at least about $10^5$ degrees Kelvin per second, said particles are at least partially gasified and reduced to char and a product gas is formed;

(g) withdrawing from said gasification stage a product stream comprising said char and product gas;

(h) separating said char from said product stream; and (i) returning at least part of said separated char to said combustion stage to provide carbonaceous matter for combustion.

2. A process for the gasification of carbonaceous fuel according to claim 1 wherein said combustion gas, introduced into said gasification stage, has a temperature of 1900° to 2800° Kelvin, a pressure of 1 to 100 atmospheres and a velocity of 10 to 500 meters per second, and the Reynolds number of the flow of said hot combustion gas around said particles is in the range of 1 to 1000.

3. A process for the gasification of carbonaceous fuel according to claim 1 wherein said fluid-dynamic accelerations to said mixed flow are provided by a sequence of variations of contour of said duct of said gasification stage.

4. A process for the gasification of carbonaceous fuel according to claim 3 wherein said sequence of variations of contour is a sequence of variations of area, whereby said duct comprises a sequence of subsonic convergent nozzles and subsonic diffusers.

5. A process for the gasification of carbonaceous fuel according to claim 3 wherein said sequence of variations of contour is a sequence of variations of direction, whereby said duct comprises a sequence of bent duct segments.

6. A process for the gasification of carbonaceous fuel according to claim 2 wherein said product stream drops in temperature at rate sufficient to substantially prevent attaining equilibrium among the gas stream components.

7. A process for the gasification of solid carbonaceous fuel comprising:

(a) combusting finely divided carbonaceous matter and an oxidizer in a combustion stage whereby said carbonaceous matter and oxidizer are reacted and products of combustion including combustion gas are formed;

(b) introducing steam into said combustion stage;

(c) introducing said combustion gas and steam under pressure to a mixing stage through which said combustion gas and steam pass at subsonic velocity and a predetermined high level of turbulence;

(d) introducing and dispersing finely divided solid fuel in said turbulent combustion gas in said mixing stage;

(e) introducing said turbulent combustion gas and steam containing said dispersed solid fuel to a gasification stage through which said combustion gas and steam containing said dispersed fuel flow at subsonic velocity and wherein said particles of dispersed fuel are strongly moved with respect to said combustion gas and steam by forcing a velocity differential between said particles and said gas using the inertia of said particles and bulk gas acceleration and deceleration, said combustion gas and steam upon introduction into said gasification stage having a temperature of 1900°–2800° Kelvin, a pressure of 1–100 atmospheres and a velocity of 20–500 meters per second and the Reynolds number of gas flow around the particles of said fuel is 1–1000 to provide with said bulk gas acceleration and deceleration an average heating rate of at least about $10^5$ degrees Kelvin per second whereby said fuel is at least partially gasified and reduced to char and a product gas is formed;

(f) withdrawing from said gasification stage a product stream comprising said char and product gas;

(g) separating said char from said product stream; and (h) returning at least part of said separated char to said combustion stage to provide carbonaceous matter for combustion.

8. A process for the gasification of solid carbonaceous fuel comprising:

(a) combusting finely divided carbonaceous matter and an oxidizer in a combustion stage whereby said carbonaceous matter and oxidizer are reacted and hot products of combustion including combustion gas are formed;

(b) introducing steam into said combustion stage;

(c) introducing said combustion gas and steam under pressure to a mixing stage through which said combustion gas and steam pass at subsonic velocity and high turbulence;

(d) introducing and dispersing finely divided solid fuel as particles in said turbulent combustion gas and steam in said mixing stage;

(e) introducing said turbulent combustion gas and steam containing said particles of dispersed solid fuel to a gasification stage through which said combustion gas and steam containing said dispersed solid fuel flow at subsonic velocity with a mean gas flow rate of 10–500 m/sec. and wherein said particles of dispersed fuel are strongly moved with respect to said combustion gas and steam by forcing a velocity differential between said particles and said gas using the inertia of said particles and bulk gas acceleration and deceleration;

(f) providing a sequence of subsonic gaseous accelerations and decelerations in said gasification stage augmenting the turbulence of said combustion gas and steam entering said gasification stage, said combustion gas and steam having an initial temperature, initial turbulence and augmented turbulence to provide an average heating rate of at least about $10^5$ degrees Kelvin per second whereby said fuel is at least partially gasified and reduced to char and a product gas is formed;

(g) withdrawing from said gasification stage a product stream comprising said char and product gas;

(h) separating said char from said product stream; and (i) returning at least part of said separated char to said combustion stage to provide carbonaceous matter for combustion.

9. The process as set forth in claim 8 wherein said product stream drops in temperature at a rate sufficient to substantially prevent attaining equilibrium among the gas stream constituents.

10. The process as set forth in claim 8 wherein the cross sectional area of said gasification stage is varied to define a sequence of subsonic nozzles and subsonic diffusers.

11. The process as set forth in claim 8 wherein gaseous products flowing through said gasification stage generally follow a longer course than said fuel as it flows through said gasification stage.

12. The process as set forth in claim 11 wherein the said variations in the walls of the gasification stage are caused to define a sequence of curved duct segments.

* * * * *

UNITED STATES PATENT AND TRADEMARK OFFICE

CERTIFICATE OF CORRECTION

PATENT NO. : 4,278,445

DATED : July 14, 1981

INVENTOR(S) : David B. Stickler, Charles W. von Rosenberg, Jr., and Richard E. Gannon It is certified that error appears in the above-identified patent and that said Letters Patent are hereby corrected as shown below:

Col. 3, line 8, for "Nos.", read--No.--; Col. 4, line 41, for "Whateever", read--Whatever--; and Col. 6, line 21, for "entrained process", read--entrained-bed gasification process--.

Signed and Sealed this

*Third* Day of *November 1981*

[SEAL]

*Attest:*

GERALD J. MOSSINGHOFF

*Attesting Officer*

*Commissioner of Patents and Trademarks*